US008567190B2

(12) United States Patent
Sumser et al.

(10) Patent No.: US 8,567,190 B2
(45) Date of Patent: Oct. 29, 2013

(54) AIR SUPPLIER, PARTICULARLY FOR AN AIR SUPPLY SYSTEM FOR FUEL CELLS

(75) Inventors: Siegfried Sumser, Stuttgart (DE); Manfred Stute, Esslingan (DE); Paul Löffler, Stuttgart (DE)

(73) Assignee: Daimler AG, Stuttgart (DE)

( * ) Notice: Subject to any disclaimer, the term of this patent is extended or adjusted under 35 U.S.C. 154(b) by 545 days.

(21) Appl. No.: 12/655,066

(22) Filed: Dec. 22, 2009

(65) Prior Publication Data

US 2010/0158722 A1 Jun. 24, 2010

Related U.S. Application Data

(63) Continuation-in-part of application No. PCT/EP2008/004461, filed on Jun. 4, 2008.

(30) Foreign Application Priority Data

Jun. 21, 2007 (DE) ..... 10 2007 028 742

(51) Int. Cl.

| | |
|---|---|
| ***F02B 33/44*** | (2006.01) |
| ***F02B 33/00*** | (2006.01) |
| ***F04D 29/44*** | (2006.01) |
| ***F04D 29/54*** | (2006.01) |

(52) U.S. Cl.
USPC ..... 60/607; 60/598; 123/559.1; 415/206

(58) Field of Classification Search
USPC ..... 60/598, 607; 123/559.1; 415/211.2, 415/148, 206
See application file for complete search history.

(56) References Cited

U.S. PATENT DOCUMENTS

| | | | | |
|---|---|---|---|---|
| 3,832,089 | A * | 8/1974 | Moellmann | 415/207 |
| 4,932,835 | A * | 6/1990 | Sorokes | 415/150 |
| 2005/0223737 | A1 * | 10/2005 | Conry | 62/510 |

FOREIGN PATENT DOCUMENTS

| | | |
|---|---|---|
| DE | 1 628 230 | 4/1972 |
| DE | 27 06 110 | 8/1978 |
| EP | 0 526 965 | 2/1993 |
| GB | 701 560 | 12/1953 |
| JP | 2006 125316 | 5/2006 |
| WO | WO 02/052110 | 7/2002 |

OTHER PUBLICATIONS

Horikawa, Machine Translation of JP 2006-125316 A, May 18, 2006.*

* cited by examiner

*Primary Examiner* — Kenneth Bomberg
*Assistant Examiner* — Audrey K Bradley
(74) *Attorney, Agent, or Firm* — Klaus J. Bach

(57) ABSTRACT

In an air supplier particularly for air supply systems for fuel cells including a compressor having a housing with a radial diffuser and including a rotor operated by an electric motor, a diverting channel is connected to the radial diffuser providing a communication path guiding the air via an axial annular channel to an inwardly extending collecting chamber via a final diffuser formed by a curved end section of a wall delimiting the annular passage and an inwardly curved wall area of the collection chamber, the compressor housing having an outer diameter is not substantially larger than the outer diameter of the electric motor.

6 Claims, 3 Drawing Sheets

AIR SUPPLIER, PARTICULARLY FOR AN AIR SUPPLY SYSTEM FOR FUEL CELLS

This is a Continuous-In-Part Application of pending international patent application PCT/EP2008/004461 filed Jun. 4, 2008 and claiming the priority of German patent application 10 2007 028 742.0 filed Jun. 21, 2007.

BACKGROUND OF THE INVENTION

The invention relates to an air supplier with a compressor having a radial diffuser, particularly for air supply systems of fuel cells operated by means of an electric motor or for exhaust gas turbochargers of internal combustion engines.

Air suppliers of the above-mentioned type are known in the state of the art and serve for supplying air to fuel cells, in particular of a fuel cell stack. They include a compressor with a compressor wheel operated by an electric motor and a radial diffuser for increasing the air pressure.

DE 1 628 280 discloses such an air supplier with a compressor in the form of an axial compressor.

However, the high space requirement of the known design is disadvantageous in connection with the above-mentioned air supplier applications.

It is therefore the object of the present invention to provide an improved air supplier of a space-saving design.

SUMMARY OF THE INVENTION

In an air supplier particularly for air supply systems for fuel cells including a compressor having a housing with a radial diffuser and including a rotor operated by means of an electric motor, a diverting channel is connected to the radial diffuser providing a communication path guiding the air via an axial annular passage to an inwardly extending coiled collecting chamber whose outer diameter is not substantially larger than the outer diameter of the electric motor.

This arrangement provides for a particularly compact design, in particular, by the formation of the collection coil which, according to the invention, extends radially inwardly so that the space between the axial annular chamber and the rotational axis is utilized in this way and the circumferential wall of the compressor can be formed in such a manner that its outer diameter is not larger than the outer diameter of the electric motor.

The arrangement of a bladed axial diffuser or vane structure in the axial annular chamber is particularly advantageous. The efficiency of the air supplier is increased thereby. The air flow entering with a pre-swirl in the axial direction is designed for the maximum possible flow retardation. By the distribution of the total flow retardation in the radial diffuser and in the axial diffuser, an additional degree of freedom is obtained for optimizing the flow retardation.

The axial annular chamber may include diffuser vanes, but it could also be formed as a vane free diffuser structure, in that the inner contour of the axial channel increases the flow cross section along the flow direction in a conical manner.

The invention will be become more readily apparent from the following description of particular embodiments with reference to the accompanying drawings.

DESCRIPTION OF A PARTICULAR EMBODIMENT

Figure 1:
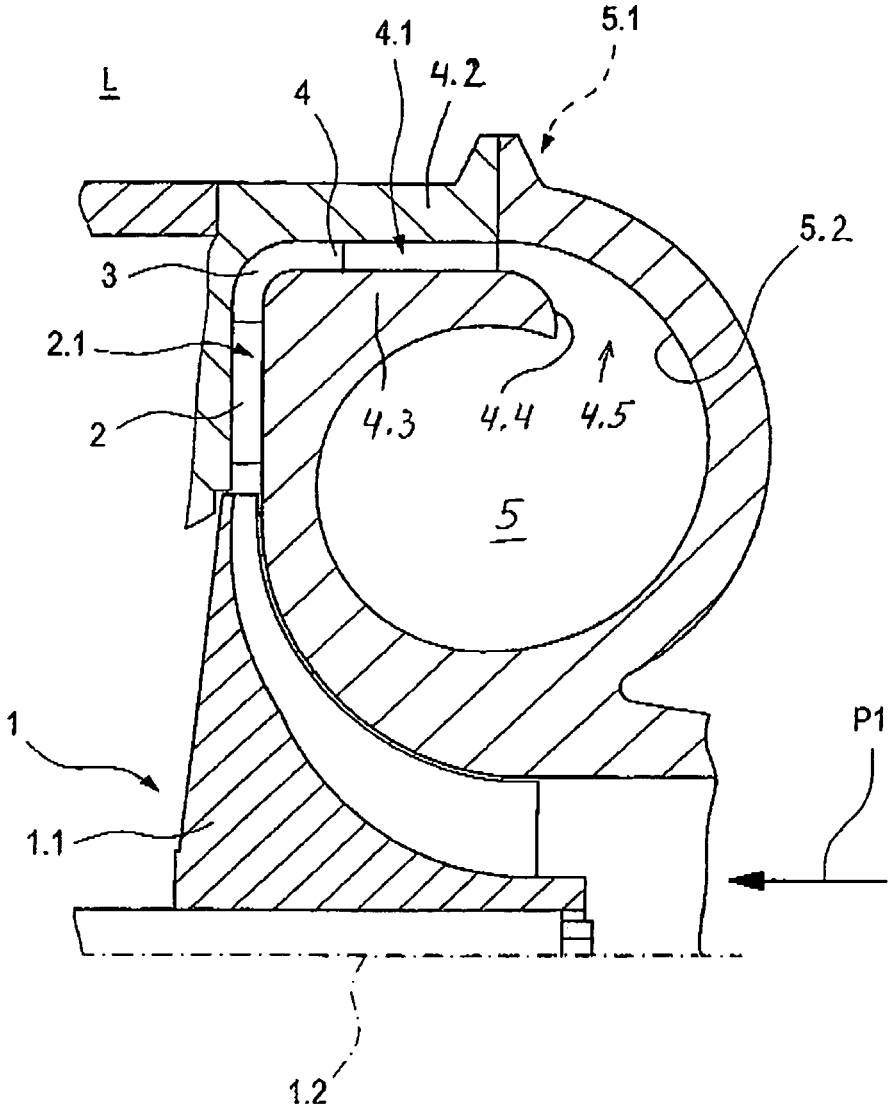
FIG. 1 is a partial sectional view of a first embodiment of an air supplier according to the invention.

Corresponding parts are provided with the same reference numerals in all figures.

In the first sectional view of a first embodiment of an air supplier L according to the invention shown in FIG. 1, the essential elements of a compressor 1 are shown. The first section only shows one half of the air supplier L, specifically the upper half of the air supplier L extending above the longitudinal axis.

The compressor 1 comprises a compressor wheel 1.1, which is arranged rotatable around the longitudinal axis 1.2. A radial diffuser 2 is arranged in the radial direction outside the compressor wheel 1.1, which diffuser is formed by two parallel side surfaces. The radial diffuser 2 can be made adjustable in a variable manner by arranging one of the side surfaces in an adjustable manner.

The radial diffuser 2 extends to an axial annular channel 4 via a diverting channel section 3, which channel 4 again empties into a coil (also called collection space), which is formed so as to extend radially inwardly toward the rotational axis 1.2, so that the available installation space within the circumferential outer wall 4.2 of the compressor 1 is utilized. The annular channel 4 is formed by the outer circumferential wall 4.2 and an inner axially extending annular guide wall 4.3 which is radially spaced from the outer circumferential wall 4.2, and is in communication with the radial diffuser 2 via a curved diverting channel section 3. The channel 4 has a constant flow cross-section and extends axially from the diverting channel section 3 adjacent the compressor wheel 1.1 and the radial diffuser 2 and, at its end, is curved radially inwardly. The collection space 5 has an inwardly curved wall section 5.2 disposed axially opposite the radial diffuser 2 and extending inwardly from the outer annular wall 4.2. The inner annular guide wall 4.3 extends toward the curved wall section 5.2 so that its radially inwardly curved end 4.4 is disposed in spaced relationship from the curved wall section 5.2 so as to form therewith a final annular diffuser structure 4.5 opening radially inwardly into the inwardly extending collection space 5. The final diffuser structure 4.5 causes the air speed to be further reduced and the air pressure to be increased. The arrangement also reduces installation space requirements. The direction of the air intake is shown by the arrow P1 shown on the right.

Air is inducted through the compressor wheel 1.1 and conveyed to the radial diffuser 2, in which a radial vane structure 2.1 is arranged. The air is conveyed outwardly in the radial diffuser 2 and thereby delayed due to the radial circumference and the flow cross-section increasing outwardly. In the diverting channel 3, the air flow is diverted by 90 degrees into the axial annular channel 4.

The axial annular channel 4 is a diffuser with opposite walls (also called axial diffuser) between which preferably an axial vane structure 4.1 is arranged. In the axial annular channel 4 the air flow which is directed axially through the axial vane structure 4.1 experiences a further delay. At the transition between the axial annular channel 4 and the collection space 5, the air flow is conveyed over the entire circumference of the axial annular channel 4 into the collection space 5, where it experiences a direction component in the circumferential direction by flow superposition and flows out via an exit 5.1. The collection space 5 is thereby formed similar to a winding of a snail shell.

The coil 5 has a relatively large constant wall thickness. The heat flow over the resulting air gap from the coil region to the entry area or the wheel outer contour region is thereby impeded.

Figure 2:
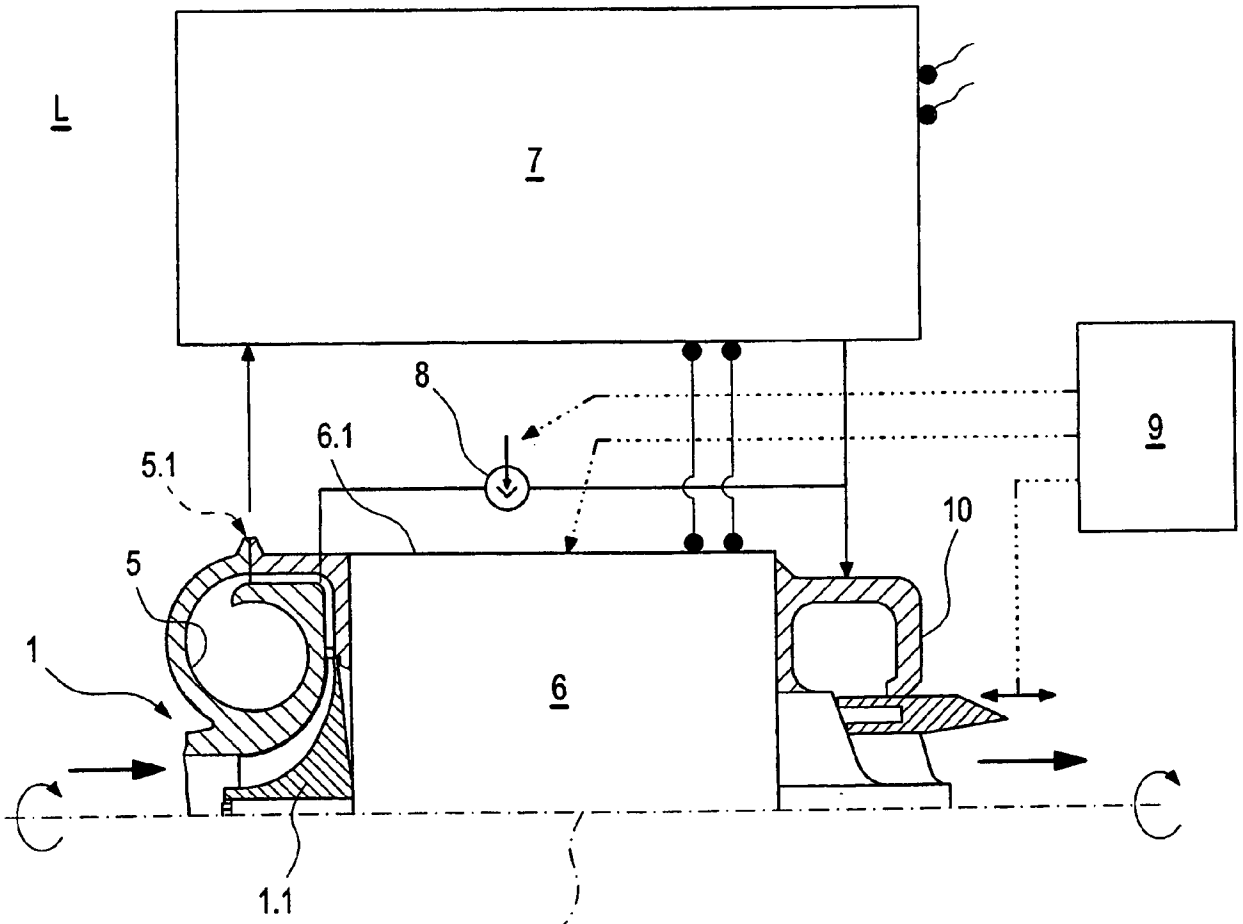
FIG. 2 shows schematically an air supplier in connection with a fuel cell.

FIG. 2 shows a larger area including the device according to the invention, wherein the compressor 1 with the coil 5 is only shown up to the longitudinal axis 1.2, as in the above-described FIG. 1. The compressor 1 shown on the left is driven by an electric motor 6, wherein the outer diameter of the compressor 1 is not larger than the diameter of the outer wall 6.1 of the electric motor 6. It is possible by the design of the air supplier L according to the invention, to keep the outer diameter of the compressor 1 as small as the diameter of the outer wall 6.1 of the electric motor 6. The installation requirement of the air supplier L is thereby considerably smaller than with air suppliers according to the state of the art, where, due to large wheel diameters and large radial diffusers with a subsequent compressor coil, diameters are common which are considerably larger than diameters of common driving electric motors. The air supplier L according to the invention thereby can be accommodated in highly limited installation spaces for example of motor vehicles. The air flow generated by the compressor 1 is supplied to a fuel cell 7 or a fuel cell stack shown schematically in the upper part of FIG. 2. A blow-down valve 8 is provided in a by-pass line for controlling the air flow by a controller 9. The air supply system of the fuel cell 7 shown in this FIG. 2 is equipped with a turbine 10 formed as an expansion turbine, especially a variable turbine. The efficiency of the system is thereby improved by the expansion of the blow-off air flow in the turbine 10.

Since compressors 1 for fuel cells 7 are designed to operate at lower specific rotational speeds and have relative small diameter ratios from the compressor wheel inlet to the wheel outlet, the required space for large coil cross sections can be very well satisfied with the air supplier L according to the invention.

It has been found to be advantageous to form the air supplier L according to the invention with a so-called region "TRIM" which is smaller than 40 percent, wherein "TRIM" is equal to the square of the quotient of the diameter of the air entry opening and the diameter of the compressor wheel 1.

Figure 3:
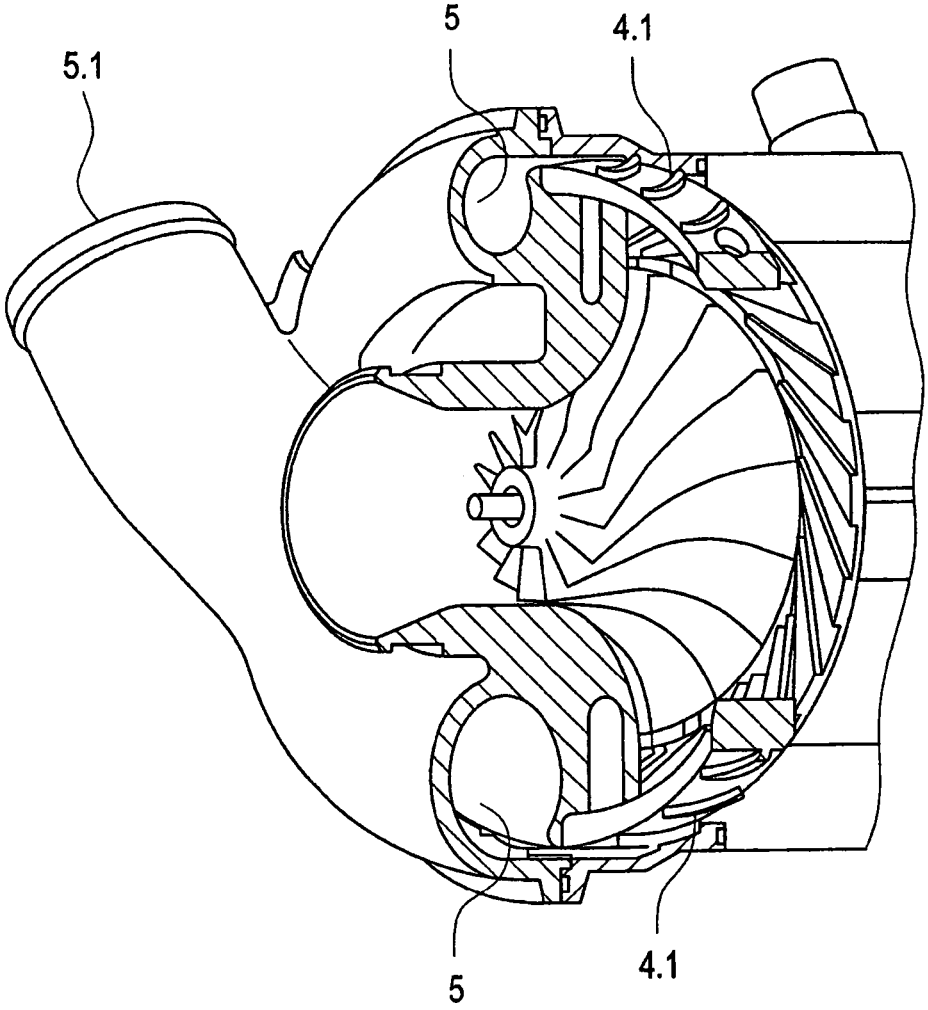
FIG. 3 is a perspective view of a part of an air supplier according to the invention.

In the perspective view of a part of an air supplier L according to the invention presented in FIG. 3, the axial vane structure 4.1 arranged in the axial annular channel 4 is visible. The axial vane structure 4.1 serves to slow down the air flow diverted from the radial diffuser 2 into the axial annular channel 4 as turbulence-free as possible in the axial direction. The diameter of the collection space 5 increases from the upper region of the shown compressor in the circumferential direction up to the outlet 5.1 of the collection space 5.

It is also possible to use the air supplier L according to the invention for the charging of internal combustion engines instead for a fuel cell air supply system, even though compressors of exhaust gas turbochargers have considerably higher specific rotational speeds than electric motors used for a fuel cell air supply system.

Although the common cramped installation spaces prevailing in vehicle construction are generally not present in connection with turbines, the concept used for the air supplier L according to the present invention can analogously also be used for turbines, that is a partial inlet nozzle structures can be used instead of the radial diffuser 2 and the axial annular channel 4 (=axial diffuser). Correspondingly, a part of the inlet nozzle structure would extends axially, and the other part of the inlet nozzle structure would extend radially to direct for example exhaust gas toward a turbine wheel. The radial nozzle structure may be a variable vane structure for adjusting the inlet flow cross section for such an arrangement.

What is claimed is:

1. An air supplier (L) comprising:

a compressor (1) with a compressor wheel (1.1) rotatably supported in a housing of the compressor (1) for air supply systems of fuel cells (7) or for exhaust gas turbocharger of internal combustion engines, the compressor (1) being operated by means of an electric motor (6), said compressor (1) including adjacent the compressor wheel (1.1):

a radial diffuser structure (2) and an axially extending annular channel structure (4) of constant cross-section formed by an outer annular compressor housing wall (4.2) and an inner annular guide wall (4.3) arranged radially spaced from the compressor housing wall (4.2) with a diverting fluid guide structure (3) disposed between the radial diffuser structure (2) and the axial annular channel structure (4), the inner annular guide wall (4.3) having an outer contour which is cylinder-shaped and in inner contour which is torus-shaped, the outer contour and the inner contour being disposed radially opposite each other, and a collection chamber (5) arranged axially adjacent the compressor wheel (1.1) and extending radially inwardly from the axial annular channel structure (4), the collection chamber (5) having an inwardly curved wall section (5.2) disposed axially opposite the radial diffuser structure (2), and the inner annular guide wall (4.3) extending toward the curved wall section (5.2) and having an inwardly curved end section (4.4) disposed in spaced relationship from the curved wall section (5.2) so as to form therewith a final annular diffuser structure (4.5) opening radially inwardly into the collection chamber (5).

2. The air supplier (L) according to claim 1, wherein the axial annular channel structure (4) is provided with axial vanes (4.1).

3. The air supplier (L) according to claim 1, wherein the axial annular channel structure (4) is a vane-free structure.

4. The air supplier (L) according to claim 1, wherein the electric motor (6) is provided axially adjacent the compressor (1) for driving the compressor (1) and the compressor has a cylinder-shaped outer housing wall, whose outer diameter is not larger than 120% of the outer diameter of the electric motor (6).

5. The air supplier (L) according to claim 1, wherein the radial diffuser structure (2) has an adjustable flow cross-section.

6. The air supplier (L) according to claim 1, wherein the radial diffuser structure (2) includes an adjustable vane structure (2.1).

* * * * *